US008866864B2

(12) United States Patent
Otsuka et al.

(10) Patent No.: US 8,866,864 B2
(45) Date of Patent: Oct. 21, 2014

(54) PRINTER AND PLATEN ROLLER FOR PRINTER

(75) Inventors: Masanori Otsuka, Tokyo (JP); Mariko Mogi, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 0 days.

(21) Appl. No.: 13/996,674

(22) PCT Filed: Dec. 20, 2011

(86) PCT No.: PCT/JP2011/007126

§ 371 (c)(1), (2), (4) Date: Jun. 21, 2013

(87) PCT Pub. No.: WO2012/086190

PCT Pub. Date: Jun. 28, 2012

(65) Prior Publication Data

US 2013/0271550 A1 Oct. 17, 2013

(30) Foreign Application Priority Data

Dec. 21, 2010 (JP) ..... 2010-284051
Feb. 3, 2011 (JP) ..... 2011-021316

(51) Int. Cl.

| | |
|---|---|
| ***B41J 11/04*** | (2006.01) |
| ***B41J 11/057*** | (2006.01) |
| ***B41J 13/02*** | (2006.01) |
| ***B41J 2/32*** | (2006.01) |
| ***B41J 3/60*** | (2006.01) |

(52) U.S. Cl.

CPC ..... *B41J 13/025* (2013.01); *B41J 11/04* (2013.01); *B41J 2/32* (2013.01); *B41J 11/057* (2013.01); *B41J 3/60* (2013.01)

USPC ..... 347/220

(58) Field of Classification Search

USPC ..... 347/171, 172, 220; 400/648, 659, 662

See application file for complete search history.

(56) References Cited

U.S. PATENT DOCUMENTS

| | | | | |
|---|---|---|---|---|
| 4,285,275 | A * | 8/1981 | Sato | 101/474 |
| 5,329,302 | A | 7/1994 | Fogle et al. | |
| 5,645,361 | A * | 7/1997 | Mitsushima et al. | 400/636 |

FOREIGN PATENT DOCUMENTS

| | | |
|---|---|---|
| JP | 1-139550 | 9/1989 |
| JP | 2005-161579 | 6/2005 |
| JP | 2005-231218 | 9/2005 |
| JP | 2005-272623 | 10/2005 |

OTHER PUBLICATIONS

International Search Report and Written Opinion dated Mar. 6, 2012 issued in corresponding International patent application No. PCT/JP2011/007126.

* cited by examiner

*Primary Examiner* — Huan Tran
(74) *Attorney, Agent, or Firm* — Ostrolenk Faber LLP

(57) ABSTRACT

A printer 1 comprising, a feed section 3 capable of feeding a print paper having a first sheet 50 and a second sheet 51 laminated to the first sheet 50 through a gap 58, and a print section 5 for printing the print paper, wherein the print section 5 comprises a thermal head 18 and a platen roller 17 being opposed to the thermal head 18, wherein the platen roller 17 comprises a shaft 30 being rotatably supported in a direction perpendicular to a feeding direction of the print paper, a cylindrical body roller 31 disposed to the shaft 30, and a projecting portion 32 protruding outward in a radial direction of the body roller 31 for filling the gap 58 by pressing the print paper.

9 Claims, 7 Drawing Sheets

PRINTER AND PLATEN ROLLER FOR PRINTER

CROSS-REFERENCE TO RELATED APPLICATIONS

The present application is a 35 U.S.C. §§371 national phase conversion of PCT/JP2011/007126, filed Dec. 20, 2011, which claims priority of Japanese Patent Application No. 2010-284051, filed Dec. 21, 2010 and Japanese Patent Application No. 2011-021316, filed Feb. 3, 2011, the contents of which are incorporated by reference herein. The PCT International Application was published in the Japanese language.

The present invention relates to a printer a printer and a platen roller, and more particularly to a printer and a platen roller for applying appropriate printing pressure to a print paper.

BACKGROUND ART

Conventionally, a double-sided label strip or continuum with no backing sheet is known. It is made by laminating a first sheet and a second sheet. On each back side or inward facing surface of the first sheet and the second sheet, an adhesive and a remover are formed alternately at positions where the adhesive of one sheet attaches temporarily to the remover of the other sheet.

When the double-sided label continuum without the backing sheet as described above is clamped with pressure between a platen roller and a thermal head and is printed, the adhesive is spread by the pressure. This generates problems because the adhesive may attach to the neighboring adhesives or to another sheet, or the adhesive may protrude from the outer edge of the label. In order to prevent such problems, a double-sided label continuum is used in which a gap is provided respectively between neighboring adhesives on the surface of a sheet.

FIG. 7 is a cross-sectional view of a double-sided label continuum viewed in a direction perpendicular to a label feeding direction, where the double-sided label continuum L has stripes or strips of adhesives 52 extending along the feeding direction and arranged with a predetermined gap 58 between neighboring adhesives. The continuum is clamped with pressure between a platen roller 59 and a thermal head 60, where the continuum is printed and fed. The double-sided label continuum L is comprised of a first sheet 50, a second sheet 51, an adhesive 52, in several stripes and a remover 53 also in several stripes. The first sheet 50 is comprised of a first coloring layer 54 and a first base material 55. A back side surface of the first coloring layer 54 and a front surface of the first base material 55 are bonded. The second sheet 51 is comprised of a second coloring layer 56 and a second base material 57, and a back side, inward facing surface of the second coloring layer 56 and a front, outward facing surface of the second base material 57 are bonded so that the first sheet 50 is bonded. On the back side, inward facing surfaces of the second base material 57 and the first base material 55, an adhesive 52 and a remover 53 are applied alternately, extending linearly parallel to the feeding direction. The adhesive stripes on the first sheet's surface alternate across the continuum with the adhesive stripes on the second sheet's surface, and the removers similarly alternate. Further, each adhesive stripe adhered to one sheet meets a remover on the other sheet. As a result, the adhesive 52 of a sheet adheres temporarily to the remover 53 of another sheet. A width G of the adhesive 52, in a direction is perpendicular to the coating direction thereof, is set smaller than a width of the remover 53. When the adhesive 52 and the remover 53 are attached temporarily, they are arrayed across a gap 58 having a width H perpendicular to the coating direction of the adhesive 52. Because a coating thickness of the adhesive 52 is thicker than a coating thickness of the remover 53, each adhesive 52 does not bond to the neighboring adhesives 52, even if the adhesive 52 is spread by the pressure applied between the platen roller 59 and the thermal head 60.

However, when printing is made on the double-sided label continuum having the above described gap 58, this generates a problem that printing precision decreases, because appropriate pressure necessary for printing is not applied to a portion of the coloring layer which is pressed to the platen roller 59 through the gap 58 and performs printing, the heat generation of the thermal head 60 is not transmitted to the coloring layer, and so printing is not made in the part.

CITATION LIST

Patent Literature

Patent literature 1: Japanese Laid-Open Patent Application Publication No. 2005-272623

SUMMARY OF INVENTION

Technical Problem

The present invention has been made in view of the above described problem. An object of the present invention is to provide a printer and a printer platen roller which are configured and arranged to provide an appropriate pressure suitable for printing on a printing paper that was made by laminating a first sheet and a second sheet through a gap, and to do so by filling the gap.

Solution to Problem

The present invention relates to a platen roller provided with a projecting portion protruding outward in a radial direction of a roller body. A printer comprises a feed section for feeding a print paper comprised of a first sheet and a second sheet laminated to the first sheet across a gap and comprises a print section for printing the print paper. The print section comprises a thermal head and a platen roller opposed to the thermal head. The platen roller comprises a shaft rotatably supported to extend in a direction perpendicular to a feeding direction of the print paper, a cylindrical roller body disposed on the shaft, and at least one projecting portion protruding outward in a radial direction from the roller body for filling the gaps between projecting portions with the roller body and the projecting portion pressing on the print paper. Further, such a configuration may be used where the print section comprises a first thermal head located upstream in a feeding direction of the print paper for printing a first surface of the print paper, a first platen roller opposed to the first thermal head, a second thermal head located downstream in the feeding direction of the print paper for printing a second surface of the print paper, and a second platen roller opposed to the second thermal head. Further, another configuration may be used where the platen roller comprises a shaft rotatably supported in the direction perpendicular to the feeding direction of the print paper, a plurality of cylindrical roller bodies disposed at spaced intervals along the shaft, and a projecting roller located between the roller bodies and protruding outwardly in a radial direction of the roller bodies for filling the gap by pressing on the print paper. The invention also relates to a printer platen roller for clamping and feeding a print paper wherein the paper has a first sheet and a second sheet laminated to the first sheet across a gap by pressing the print paper to a thermal head. The roller comprises a shaft rotatably supported in a direction perpendicular to a feeding direction of the print paper, a cylindrical roller body disposed on the shaft, and a projecting portion protruding outward in a radial direction of the roller body for filling the gap substantially by pressing the print paper.

Advantageous Effects of Invention

By using the printer and the printer platen roller of the present invention, when printing is performed on a print paper having a first sheet and a second sheet laminated to the first sheet across a gap, it becomes possible to apply appropriate pressure necessary for printing uniformly on the print paper with a simple configuration of only a structure of the platen roller, without using any expensive and complicated equipment such as a controller, etc. The printer of the invention makes it possible to keep print quality at a predetermined level. The printer platen roller of the invention makes it possible to deal with a print paper having a different gap dimension, etc., by a simple operation.

DESCRIPTION OF EMBODIMENTS

Example 1

The example 1 shall be described with reference to FIGS. 1 to 4. In addition, in the following, for the same parts as those in the conventional art, only the same signs are assigned and duplicated descriptions are omitted.

Figure 1:
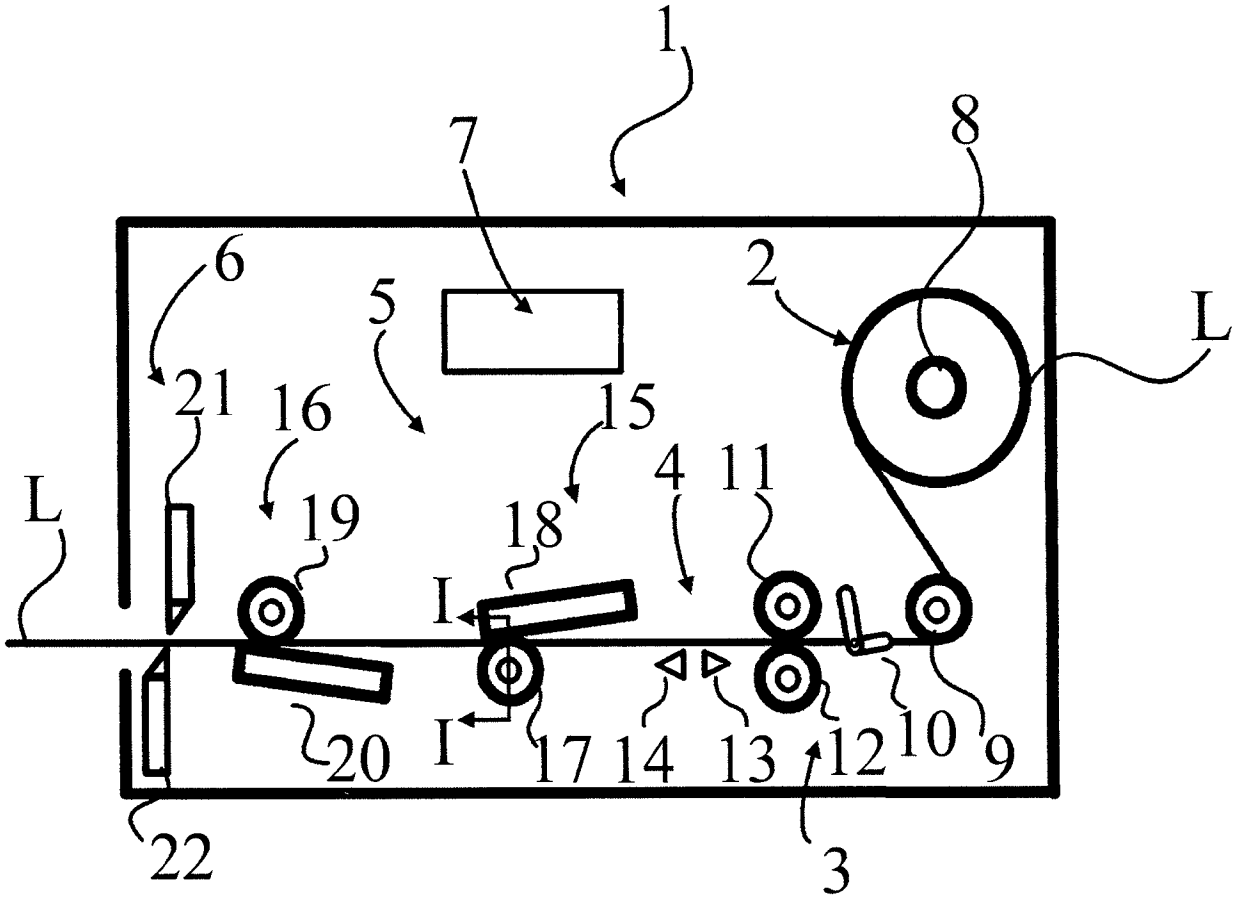
FIG. 1 is a side view of a double-sided label printer 1, where a printer according to an example 1 of the present invention is applied.

FIG. 1 is a side view of a double-sided label printer 1 according to the example 1 of the present invention. As shown in the Figure, the double-sided label printer 1 is comprised of a label supply section 2, a label feed section 3, a label detection section 4, a label print section 5, a label cut section 6, and a control section 7.

The label supply section 2 is configured so as to mount a rolled double-sided label continuum L to a label supply reel 8, and to supply the double-sided label continuum L to the label feed section 3.

The label feed section 3 is comprised of a guide roller 9, a label width regulating guide 10, a driven roller 11, and a drive roller 12. The guide roller 9 is disposed rotatably at an upstream position from the label print section 5 and guides the label continuum, without a backing paper, so that the continuum is fed to the label print section 5. The label width regulating guide 10 is located between the guide roller 9, and the driven roller 11 and the drive roller 12. By regulating the width of the double-sided label continuum L, each of a plurality of projecting portions 32 of a first platen roller 17 to be described later, feed the double-sided label L to the label print section 5 so that the projecting portions of and the paper mate with a corresponding gap 58 without causing serpentine of the label across the feeding direction. The drive roller 12 and the driven roller 11 are opposed to each other on an upstream side of the label print section 5, and on a downstream side of the label width regulating guide 10, so as to clamp and feed the label continuum L without a backing paper to the label print section 5 while preventing generation of serpentine and slack. One end of the shaft of the drive roller 12 is connected to a motor (not shown) through a belt, and is configured to rotate in either the feeding direction or the opposite direction by a force transmitted from a drive source. In addition, the label width regulating guide 10, the driven roller 11 and the drive roller 12 may be located between a label detection section 4 and a first print section 15, or between a first print section 15 and a second print section 16, so that each of the plurality of projecting portions 32 of a first platen roller 17 and a second platen roller 19 may mate within a corresponding gap 58 without a lateral shift.

A label detection section 4 is comprised of a light emitter 13 and a light receiver 14. The light emitter 13 and the light receiver 14 are located on the upstream side of the label print section 5, and on the downstream side of the label feed section 3, and at a back surface side of the double-sided label continuum L. On the back, outwardly facing surface of the double-sided label continuum L, marks (not shown) that reflects light emitted from the light emitter 13 are printed at equal length intervals. The label detection section 4 detects a position and a feeding amount of the double-sided label continuum L, by emitting light from the light emitter 13 to the back surface of the and double-sided label continuum L and receiving the light reflected from the marks at the light receiver 14.

A label print section 5 is comprised of a first print section 15 and a second print section 16. The first print section 15 is comprised of a first platen roller 17 and a first thermal head 18. The first platen roller 17 is opposed to the back surface side of the double-sided label continuum L and the first thermal head 18 is opposed to the front surface side of the double-sided label continuum L. The platen roller and the thermal head clamp the double-sided label continuum L by applying a predetermined pressing force and print on the surface of the double-sided label continuum L and then feed the printed one. The second print section 16 is comprised of a second platen roller 19 and a second thermal head 20. The second platen roller 19 is opposed to the front surface side of the double-sided label continuum L and the second thermal head 20 is opposed to the back surface side of the double-sided label continuum L. The platen roller 19 and the thermal head 20 clamp the double-sided label continuum L by applying a predetermined pressing force and print on the surface of the double-sided label continuum L and then feed the printed one to a label cut section 6.

The label cut section 6 comprises an upper cutter 21 and a lower cutter 22. The upper cutter 21 and the lower cutter 22 are opposed on a downstream side of the label print section 5, so that a blade of the upper cutter 21 mates with a blade of the lower cutter 22. The double-sided label continuum L is clamped between the upper cutter 21 and the lower cutter 22, and is cut by driving the lower cutter 22.

A control section 7 comprises CPU, ROM, RAM, etc. (not shown), and is connected to the above mentioned sections 2, 3, 4 through a data bus (not shown), and controls the operation of each section.

Figure 2:
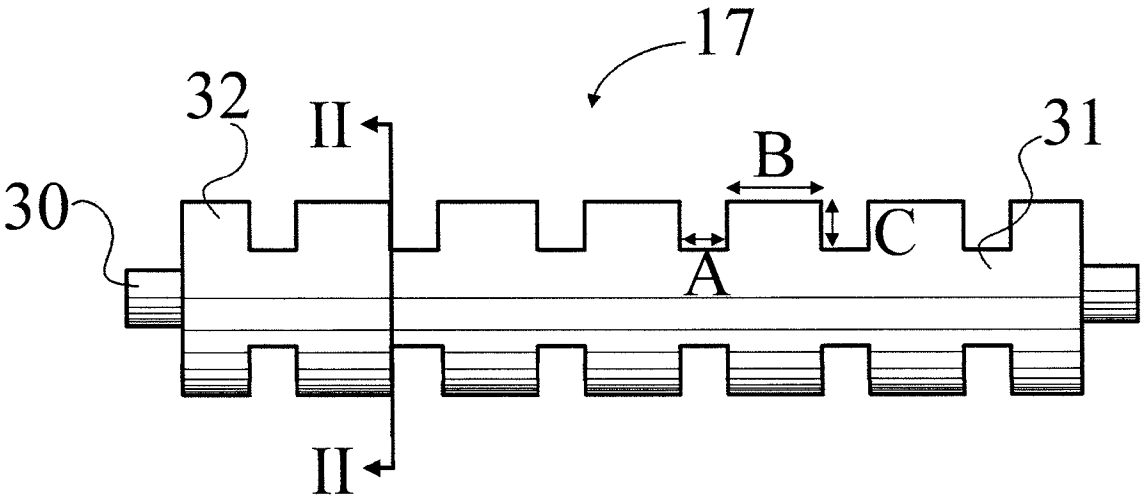
FIG. 2 is a front view of a first platen roller 17 in FIG. 1 for use with the printer according to the example 1.

Next, the first platen roller 17 and the second platen roller 19 are described in detail. FIG. 2 is a front view of the first platen roller 17 according to the example 1 of the present invention. The second platen roller 19 has a configuration similar to that of the first platen roller 17, and so descriptions thereof shall be omitted.

A shaft 30 has a cylindrical rod shape and is made of a metal such as a stainless steel. The shape is not limited to the cylindrical rod shape. A cylindrical tube shape or the like is possible. With regard to the material, a resin can be used for the shaft, so that the shaft is not limited to a metal. Both ends of the shaft are pivotally supported by the bearing (not shown) of the double-sided label printer 1 so as to be opposed to the thermal head 18. One end of the shaft is connected to a motor (not shown) through a belt, and is configured to rotate in either the feeding direction or the opposite direction by a force transmitted from a drive source.

A single piece roller body 31 has an empty central axis region and is comprised of an elastic body, such as an urethane rubber, a silicone rubber, etc. The shaft 30 is inserted into the empty central axis and is fixed there. When the shaft 30 is rotationally driven, the roller body 31 is also rotationally driven together with the shaft.

Figure 3:
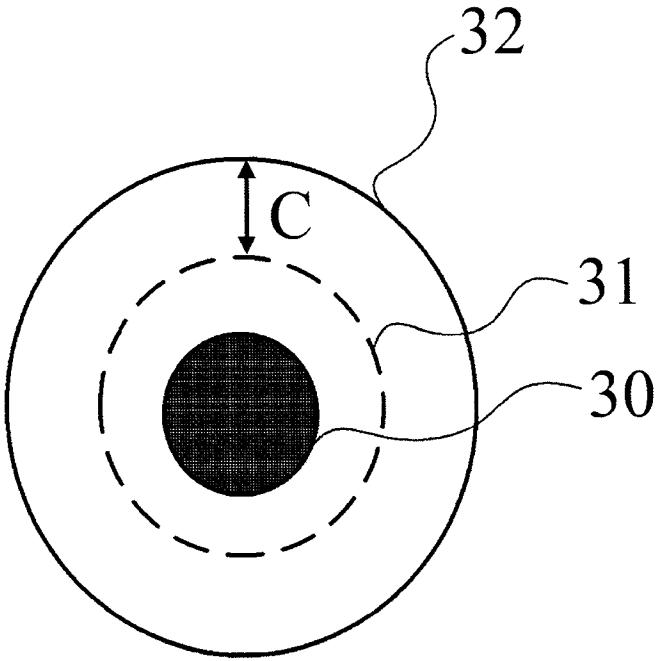
FIG. 3 is a cross-sectional view taken along a line II-II in FIG. 2, for use with the printer according to the example 1.

A plurality of projecting portions 32 are provided at predetermined axially spaced intervals along the periphery of the roller body. Each portion 32 has a rectangular shape cross section in the axial direction and protrudes outwardly in a radial direction. The axis direction cross-sectional shape of the projecting portions 32 is not limited to the rectangular shape. For an appropriate pressure to be applied to printing on a first coloring layer 54, a circular shape, an elliptical shape, or the like can be used, for example. A predetermined interval length 'A' axially in the shaft 30 direction between each two of the plurality of the projecting portions 32 corresponds to a width 'G' of an adhesive 52. When the projecting portion 32 presses the second sheet 51, a remover 53 is rolled up in the direction of an adhesive 52. Therefore, it is desirable for the adhesive 52 to have a length enough for rolling up the remover 53, in addition to 'G'. A length 'B' of the projecting portion 32 in the shaft 30 direction axially corresponds to a width 'H' of a gap of the double-sided label continuum L. In order to prevent the adhesive 52 coated on the second sheet 53 from attaching to a protruding second base material 57, it is desirable for the length 'B' of the projecting portion to have a length shorter than 'H', and to have a length long enough for applying an appropriate pressure to a first coloring layer 54. A height 'C' protruding outward in a radial direction as shown in FIG. 3 corresponds to a thickness 'c' of the adhesive 52. In order to apply a uniform printing pressure to the first coloring layer 54, it is desirable for height 'C' of a projecting portion to have substantially the same radial length, that is height, as 'I', the height of a groove.

Figure 4:
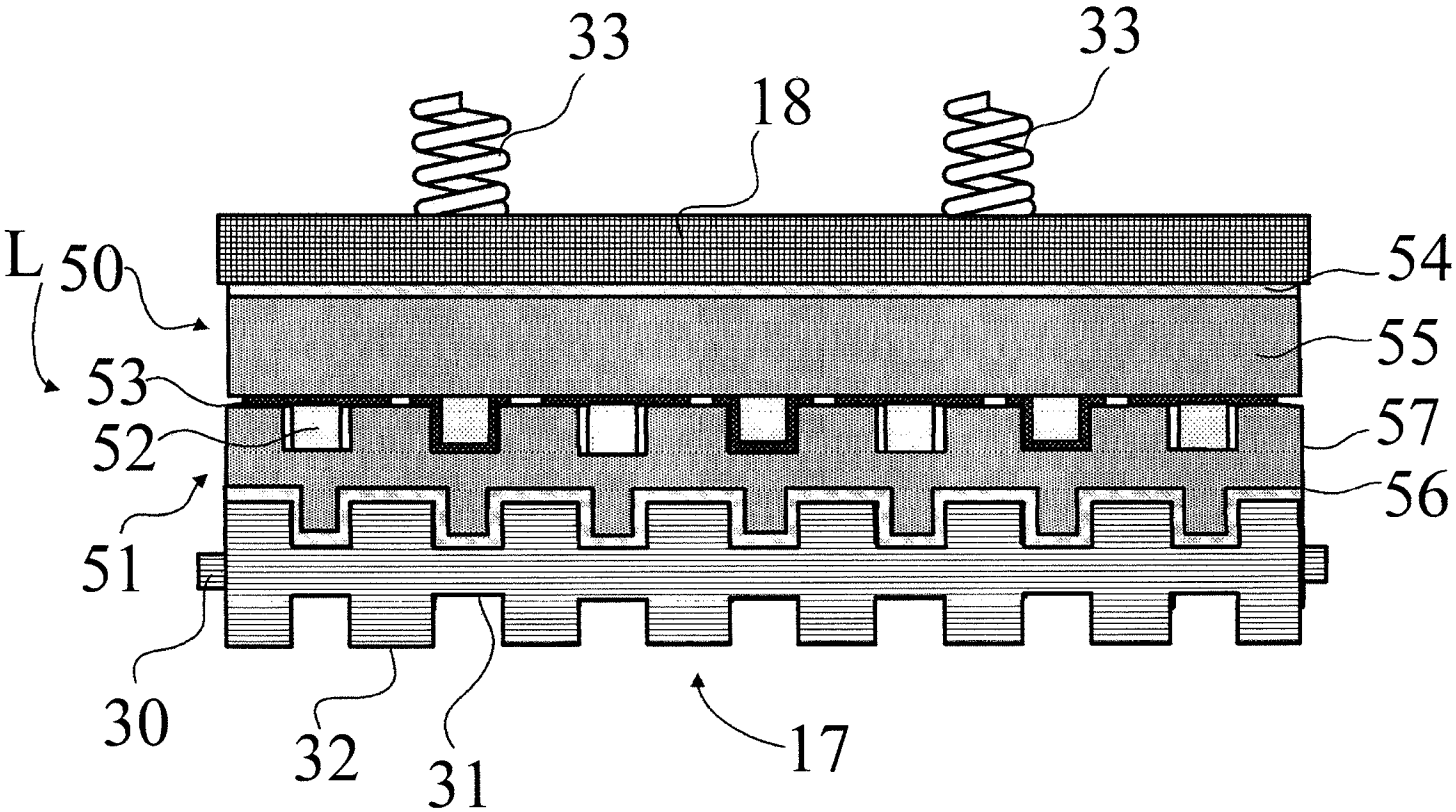
FIG. 4 is a cross-sectional view taken along a line I-I in FIG. 1 when a first platen roller 17 of FIG. 1 is pressed to a thermal head 20, for use with the printer according to the example 1.

The double-sided label printer 1 according to the example 1 has the above described configuration. The double-sided label continuum L is supplied by the label supply section 2, the width of the supplied double-sided label continuum L is regulated by the width regulating guide 12 of the label feed section 3, and further the double-sided label continuum L is fed to the label print section 5 while being prevented from serpentine and skewing by being pressure clamped between the driven roller 11 and the drive roller 12. The double-sided label continuum L fed to the label print section 5 is pressure clamped between the first platen roller 17 and the first thermal head 18 being pressed by the press spring 33, at the first print section 15, as shown in FIG. 4. The projecting portion 32 presses the second sheet 51 in the gap 58 direction so that the second sheet 51 deforms and protrudes toward the gap 58, and the gap 58 of the double-sided label continuum L is filled. In FIG. 4, the lower sheet 57 deforms into the gaps between projecting portions 32 as pressure is applied. As a result, the first coloring layer 54 is pressed with an appropriate pressure for printing, receives heat at a contact point of a heating element of the thermal head 18 and the coloring layer 54, and a set information is printed at a predetermined set position. After the print is made on the first coloring layer 54, the double-sided label continuum L is fed to the second print section 16 and is pressure clamped between the second platen roller 19 and the second thermal head 20, and then a printing is made to the second coloring layer 56 in the same manner as that at the above-described first print section 15. After the print was made on both sides, the upper cutter 21 and the lower cutter 22 are driven at the label cut section 6, and the double-sided label continuum L is cut at a set position.

According to the example 1 described as above, even when an appropriate pressure necessary for printing is not applied to the first coloring layer 54 to be printed thereon, due to the existence of the gap 58 between the first sheet 50 and the second sheet 51 of the double-sided label continuum L, the gap 58 is filled, and an appropriate pressure for printing can be applied, by pressing the projecting portion 32 provided along the periphery of the platen roller 17 to another sheet (the second sheet 51). Further, the shaft 30 direction length 'A' of the interval between each of the plurality of the projecting portions 32 is set to be longer than the shaft 30 direction length 'G' of the adhesive 52, and the shaft 30 direction width 'B' of the projecting portions 32 is set to a length to the extent so that an appropriate printing pressure is applied, and to be shorter than the shaft 30 direction width 'H' of the gap 58. As a result, it becomes possible to prevent attaching of a protruding other sheet to the adhesive 52, and to prevent that the smoothness of another sheet surface is inhibited thereby, and to operate printing smoothly. Further, by setting the length 'C' protruding in a radial direction of the projecting portion 32 to be substantially the same as the thickness 'I' of the adhesive 52, the protruding length 'C' of another sheet substantially coincides with the thickness 'I' of the adhesive 52, and a uniform pressure can be applied to the coloring layer to be printed. Further, only by providing the platen roller 17 with the projecting portion 32, an appropriate pressure for printing can be applied and a printing accuracy can be maintained at a predetermined level, without using an expensive controller or the like which needs space. Further, even when a double-sided label continuum L having a different dimension in any of the adhesive 52, the gap 58, and the remover 53 is used, it is possible to accommodate to the difference, by only replacing the platen roller 17 with one having dimensions of the projecting portion 32 and by being made to correspond to each dimension of the double-sided label continuum L.

In addition, although the length 'C' protruding in a radial direction of the projecting portion 32 is set to be substantially the same as the thickness 'I' of the adhesive 52, the length 'C' can be changed appropriately, depending on an elastic modulus, etc., of the adhesive, since it is enough to apply substantially the same pressure as that at the pressed portion by the body roller 42, when the double-sided label continuum L is pressure clamped between the platen roller 40 and the thermal head 18 and is printed.

In this embodiment, the adhesive is sufficient to hold the sheets together during printing and use, until separation of sheets is performed, and the remover is a material, on the surface of the base material 55 and 57 that prevents contact between the adhesive on one sheet and the surface of the opposing sheet and that also permits subsequent separation of the two sheets, with each sheet keeping its respective stripes of adhesive and of remover after separation.

Example 2

Next, the first platen roller 40 according to the example 2 shall be described with reference to FIGS. 5 and 6. Description of the second platen roller (not shown) having the same configuration as that of the first platen roller 40 shall be omitted. With regard to the similar portions as those in the example 1, only the same reference sign shall be assigned, and duplicated description shall be omitted.

Figure 5:
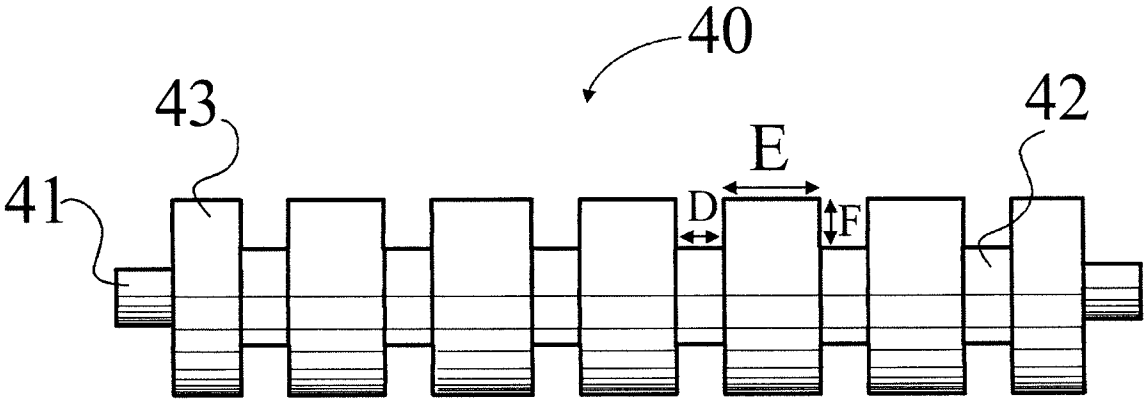
FIG. 5 is a front view of a first platen roller 40 of an example 2 of the present invention.
Figure 6:
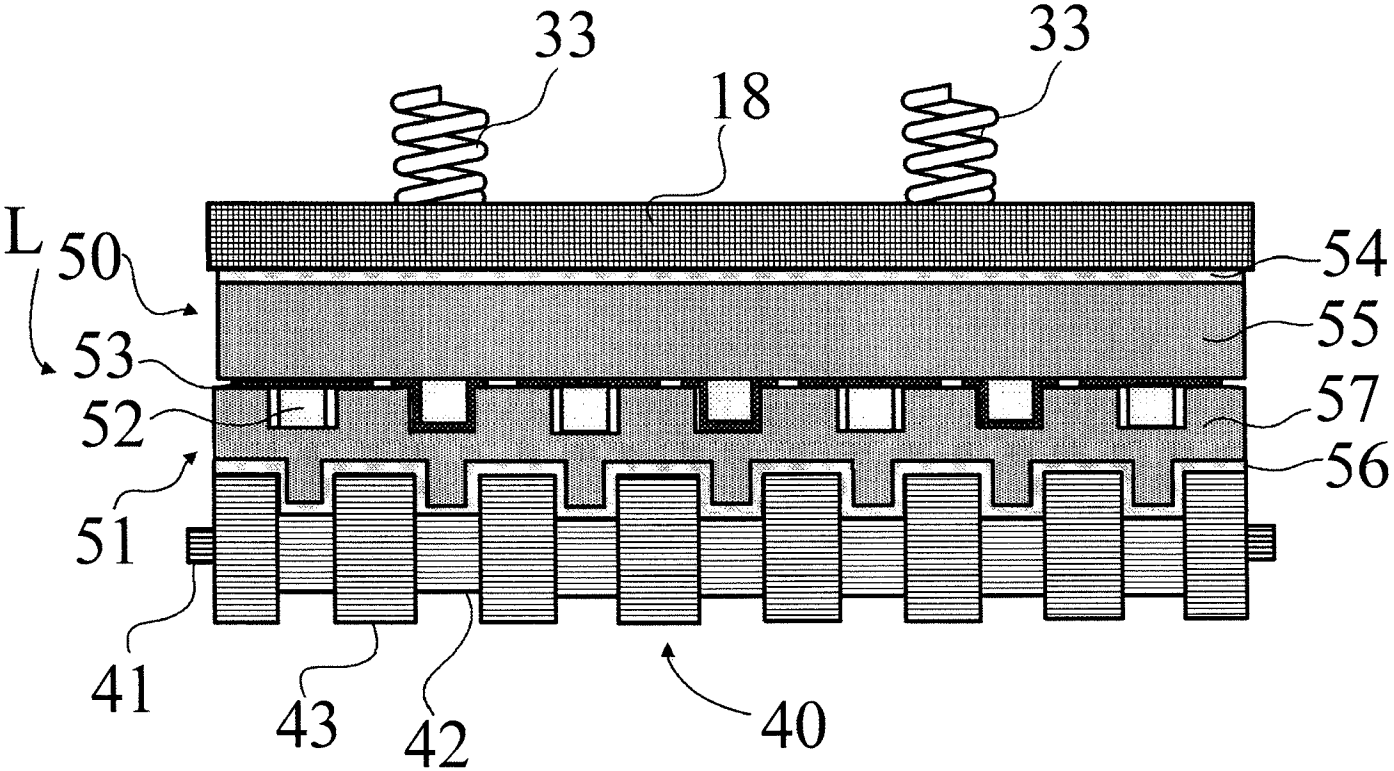
FIG. 6 is a front view of the first platen roller 40 of the example 2 of the present invention when the first platen roller 40 is pressed to a first thermal head 18.
Figure 7:
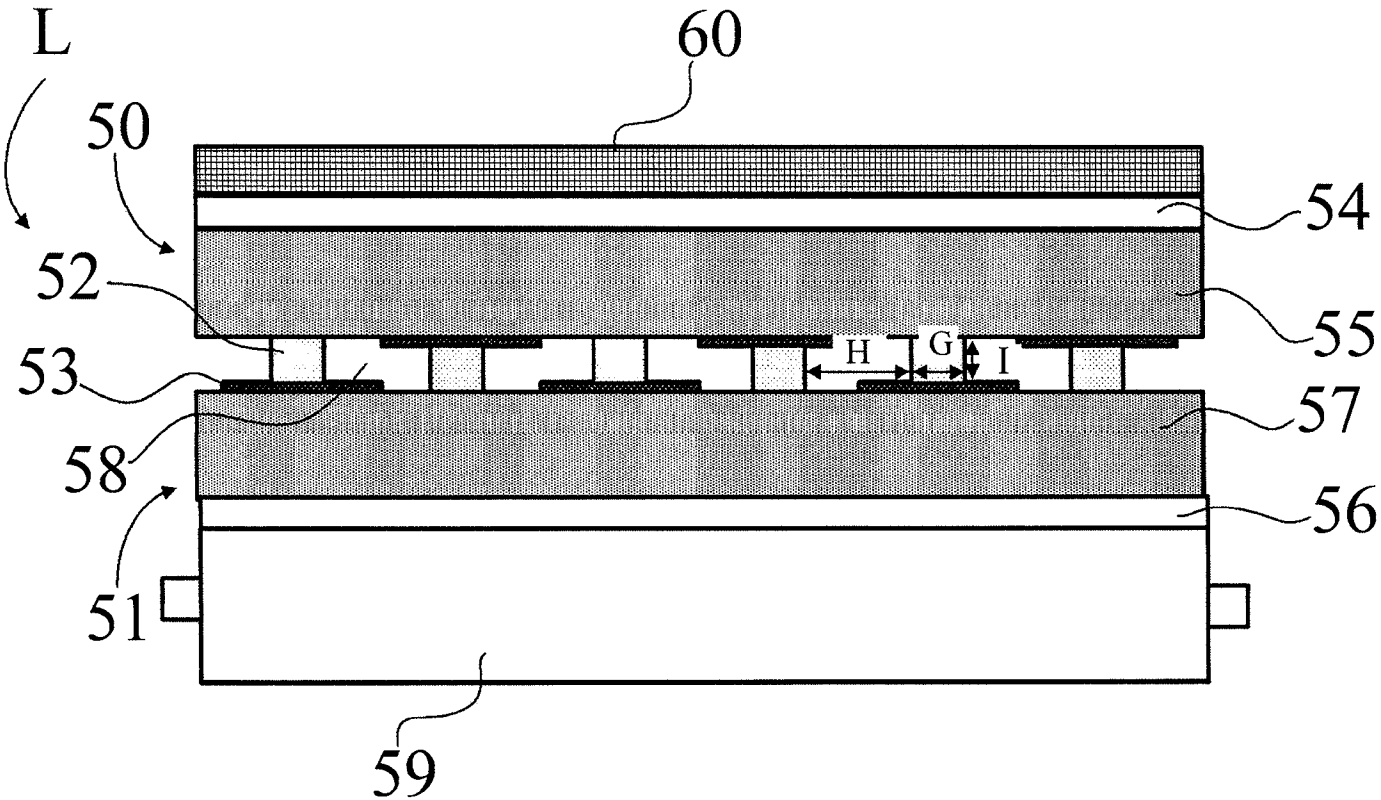
FIG. 7 is a cross-sectional view of a conventional double-sided label continuum L having a gap 58 that remains when a platen roller 59 is pressed to a thermal head 60.

FIG. 5 is a front view of the first platen roller 40 according to the example 2. As shown, the first platen roller 40 is comprised of a shaft 41, a roller body 42 and projections 43. The shaft 41 has the same configuration as that of the shaft 30, and so description is omitted.

The roller body 42 has an empty central axis and is made of an elastic body such as an urethane rubber, a silicone rubber, etc. The shaft 41 is inserted into the empty central axis at a predetermined interval and is fixed. When the shaft 41 is rotationally driven, the roller body 42 is also rotationally driven together. A length 'D' of parts of the roller body 42 in the shaft direction corresponds to a width 'G' of the adhesive 52. Because a remover 53 is rolled up along an adhesive 52 direction, in a process when a projecting roller 32 presses a second sheet 51 and a gap 58 is filled, it is desirable for the length 'D' to have a length enough for winding up the remover 53 in addition to the width 'G'.

Like the roller body 42, each projecting roller 43 has an empty central axis and is made of an elastic body. The shaft 41 is inserted into the empty central axis through the roller body 42 and is fixed. When the shaft 41 is rotationally driven, each projecting roller 43 is also rotationally driven together. A length 'E' of each projecting roller 43 in the shaft 41 direction corresponds to a width 'H' of a gap of the double-sided label continuum L. In order to prevent the adhesive 52 coated on the second sheet 53 from attaching to a protruding second base material 57, it is desirable for the length 'E' to have a length shorter than width 'H', and have a length enough for applying an appropriate pressure to a first coloring layer 54. A radial height 'F' of the projecting roller 43 protruding outward in the radial direction corresponds to a thickness 'I' of the adhesive 52 when the double-sided label continuum L is pressure clamped between the first platen roller 40 and the first thermal head 18 at printing. It is desirable for the height 'F' to have substantially the same length as thickness 'I', in order to apply a uniform pressure to a coloring layer 54.

The first platen roller 40 according to the example 2 has the above described configuration. As shown in FIG. 6, by the process in which the platen roller 40 presses the double-sided label continuum L, each projecting roller 43 protrudes so that the second sheet 51 enters into the gap 58, and the gap 58 is filled, and an appropriate pressure for printing is applied to the coloring layer 54 almost uniformly, and printing is performed with high precision.

According to the example 2 as described above, even when an appropriate pressure necessary for printing is not applied to the first coloring layer 54 to be printed thereon, due to the existence of the gap 58 between the first sheet 50 and the second sheet 51 of the double-sided label continuum L, the gap 58 is filled, and an appropriate pressure for printing can be applied, by pressing the first platen roller 40 to the non-printing sheet (the second sheet 51) so that the second sheet 51 protrudes toward the gap 58. Further, by providing a length of an extent to which the remover 53 can be rolled up, in addition to the width 'G' of the corresponding adhesive 52, to the length 'D' of the body roller 42 in the shaft 41, rolling up of the remover 53 of the second sheet 51 caused by the pressing can be carried out smoothly without load. By setting the length 'E' of the projecting roller 43 to be shorter than the width 'H' of the gap 58, and to a length to the extent so that an appropriate printing pressure is applied, the adhesive 52 extending to the shaft 41 by the pressing and attaching to the second base material 57 can be prevented. By setting the length 'F' protruding outward in a radial direction of the projecting roller 43 to be substantially the same as the thickness 'I' of the adhesive 52 being pressure clamped at printing, about the same pressure as the pressure applied to the portion which is pressed through the adhesive 52 can be applied to the portion of the first coloring layer 54 which is pressed through the gap 58. Further, even if one projecting roller 43 is damaged by abrasion or the like, only the damaged projecting roller 43 should be replaced, and so the cost can be reduced and the work efficiency can be increased. Further, with regard to double-sided label continuums L having different dimension or the like of the gap, the adhesive, and the remover of the double-sided label continuum L, it is possible to accommodate to various double-sided label continuums L, by combining a roller body 42 and projecting rollers 43 corresponding to each dimension or the like.

In addition, although the length 'F' protruding outward in a radial direction of the projecting roller 43 is set to be substantially the same as the thickness of the adhesive 52, it is not particularly applicable in a case where the roller body 42 and the projecting roller 43 have different elastic modulus, since it is enough to apply substantially the same pressure as that at the pressed portion by the body roller 42, when the double-sided label continuum L is pressure clamped between the platen roller 40 and the thermal head 18 and is printed.

In this embodiment, a number, a position, a shape or the like of each member is not limited to the embodiment described above. The number, the position, the shape or the like can be set suitably for carrying out the present invention. It is apparent the present invention is not limited to each of the above described embodiments, and the embodiment can be modified appropriately within the scope of the technical concept of the present invention.

The invention claimed is:

1. A printer, comprising:

a feed section configured for feeding a print paper having a first sheet and having a second sheet laminated to the first sheet through a gap between the sheets;

a print section downstream from the feed section for printing the print paper, the print section comprises at least one thermal head and at least one platen roller opposed to the thermal head, the feed section feeding the print paper between the thermal head and the platen roller;

the platen roller comprises:

a shaft rotatably supported and extending in a direction perpendicular to a feeding direction of the print paper; and a cylindrical roller body disposed to the shaft, and a plurality of projecting portions protruding outward in a radial direction from the roller body and toward the thermal head for filling the gap with the print paper upon at least the projecting portions pressing on the print paper.

2. The printer according to claim 1, wherein the print section comprises:

a first one of the thermal heads located upstream in a feeding direction of the print paper and above a first surface of the print paper for printing the first surface of the print paper;

a first one of the platen rollers opposed to the first thermal head;

a second one of the thermal heads located downstream in the feeding direction of the print paper and above a second surface of the print paper for printing the second surface of the print paper; and a second one of the platen rollers opposed to the second thermal head.

3. The printer according to claim 1, wherein the platen roller comprises:

the plurality of the cylindrical bodies roller being disposed on the shaft; and a projecting roller being located between the bodies roller and protruding outward in a radial direction of the bodies roller for filling the gap by pressing the print paper.

4. A printer platen roller for clamping and feeding a print paper comprising a first sheet and a second sheet laminated to the first sheet through a gap by pressing the print paper to a thermal head, the roller comprising:

a shaft rotatably supported in a direction across a feeding direction of the print paper;

a cylindrical roller body disposed to the shaft; and a projecting portion protruding outward in a radial direction of the roller body for filling the gap substantially by pressing on the print paper.

5. The printer according to claim 1, wherein the first sheet has a first back surface and the second sheet has a second back surface and the first and second back surfaces face toward each other;

a first plurality of stripes of an adhesive at spaced intervals across a width of the print paper and extending along the first back surface of the first sheet in the feed direction of the print paper;

a second plurality of stripes of an adhesive at spaced intervals across the width of the print paper and extending along the second back surface of the second sheet in the feed direction;

the first and second pluralities of stripes alternating in location across width of the print paper, so that a first adhesive stripe does not oppose a second adhesive stripe;

first removers applied at the first back surface, and the first removers respectively opposing each of the second adhesive stripes on the second back surface; and second removers at the second back surface, and the second removers respectively opposing each of the first adhesive stripes on the first back surface;

wherein each of the removers enables the respective adhesive stripe which the remover opposes to permit separation of the first and second sheets between the respective stripe of adhesive and the respective remover thereof.

6. The printer of claim 1, wherein along an axial length of the platen roller, the projecting portions are separated and define gaps between the portions, and the gaps are configured and located such that the sheet then at the roller is deformable into the gaps between the projecting rollers upon pressing on the paper by the platen roller and the thermal head.

7. The printer according to claim 6, wherein the projecting portions and the gaps are so placed that the adhesive stripes are located along a length of the platen roller at the same location along the length of the platen roller as the gaps between the projecting portions.

8. The printer of claim 7, wherein the gaps between the projecting portions of the platen roller are of a selected width along the platen roller and the respective adhesive stripe for each gap is of a slightly smaller width across the width of the roller.

9. The printer of claim 7, wherein the gaps between the projecting portions of the platen roller are of a selected depth, and the adhesive stripes of each sheet are of about the selected depth to contact the respective removers on the other of the sheets.

* * * * *